US011156064B2

(12) United States Patent
Zhao et al.

(10) Patent No.: US 11,156,064 B2
(45) Date of Patent: Oct. 26, 2021

(54) NATURAL GAS HYDRATE SOLID-STATE FLUIDIZATION MINING METHOD AND SYSTEM UNDER UNDERBALANCED POSITIVE CIRCULATION CONDITION

(71) Applicant: SouthWest Petroleum University, Sichuan (CN)

(72) Inventors: Jinzhou Zhao, Sichuan (CN); Na Wei, Sichuan (CN); Haitao Li, Sichuan (CN); Liehui Zhang, Sichuan (CN); Shouwei Zhou, Sichuan (CN); Qingping Li, Sichuan (CN); Wantong Sun, Sichuan (CN)

(73) Assignee: SOUTHWEST PETROLEUM UNIVERSITY, Sichuan (CN)

( * ) Notice: Subject to any disclaimer, the term of this patent is extended or adjusted under 35 U.S.C. 154(b) by 157 days.

(21) Appl. No.: 16/604,106

(22) PCT Filed: Nov. 20, 2018

(86) PCT No.: PCT/CN2018/116457
§ 371 (c)(1),
(2) Date: Oct. 9, 2019

(87) PCT Pub. No.: WO2019/223265
PCT Pub. Date: Nov. 28, 2019

(65) Prior Publication Data

US 2020/0300066 A1 Sep. 24, 2020

(30) Foreign Application Priority Data

May 25, 2018 (CN) ..... 201810515239.0

(51) Int. Cl.

| | |
|---|---|
| ***E21B 41/00*** | (2006.01) |
| ***E21B 21/00*** | (2006.01) |
| ***E21B 21/08*** | (2006.01) |
| ***E21B 43/34*** | (2006.01) |
| ***E21B 21/06*** | (2006.01) |
| ***E21B 43/40*** | (2006.01) |

(52) U.S. Cl.
CPC ..... *E21B 41/0099* (2020.05); *E21B 21/065* (2013.01); *E21B 21/085* (2020.05); *E21B 43/35* (2020.05); *E21B 43/40* (2013.01); *E21B 21/001* (2013.01)

(58) Field of Classification Search
CPC ..... E21B 41/0099; E21B 21/085; E21B 43/40
See application file for complete search history.

(56) References Cited

FOREIGN PATENT DOCUMENTS

| | | |
|---|---|---|
| CN | 101182771 A | 5/2008 |
| CN | 103628844 A | 3/2014 |

(Continued)

*Primary Examiner* — Robert E Fuller
(74) *Attorney, Agent, or Firm* — Muncy, Geissler, Olds & Lowe, P.C.

(57) ABSTRACT

A natural gas hydrate solid-state fluidization mining method and system under an underbalanced positive circulation condition, used for performing solid-state fluidization mining on a non-rock-forming weak-cementation natural gas hydrate layer in the ocean. Equipment includes a ground equipment system and an underwater equipment system. The construction procedure has an earlier-stage construction process, underbalanced hydrate solid-state fluidization mining construction process and silt backfilling process. Natural gas hydrates in the seafloor are mined through an underbalanced positive circulation method.

9 Claims, 1 Drawing Sheet

(56) References Cited

FOREIGN PATENT DOCUMENTS

| | | | |
|---|---|---|---|
| CN | 106761588 | A | 5/2017 |
| CN | 106939780 | A | 7/2017 |
| CN | 107642346 | A | 1/2018 |
| JP | 2016138402 | A | 8/2016 |
| WO | WO-03/021079 | A1 | 3/2003 |

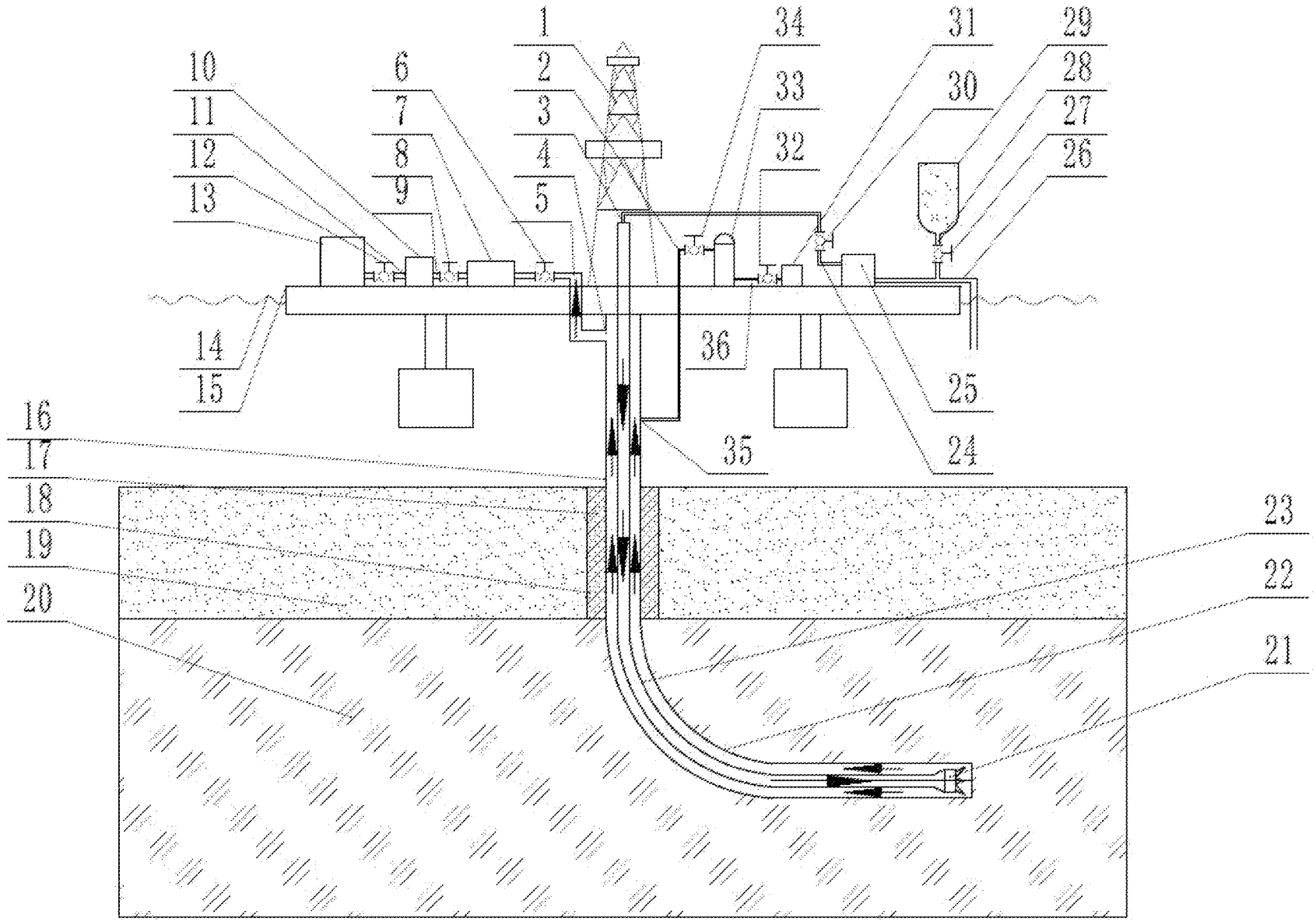
1
2
3
4
5
6
7
8
9
10
11
12
13
14
15
16
17
18
19
20
21
22
23
24
25
26
27
28
29
30
31
32
33
34
35
36

NATURAL GAS HYDRATE SOLID-STATE FLUIDIZATION MINING METHOD AND SYSTEM UNDER UNDERBALANCED POSITIVE CIRCULATION CONDITION

TECHNICAL FIELD

The present invention relates to the technical field of unconventional oil and gas resource development, in particular to a hydrate solid-state fluidization mining method and system under an underbalanced positive circulation condition.

BACKGROUND

Natural gas hydrate is a non-stoichiometric cage crystal formed by water and natural gas in high pressure and low temperature environments, and is thus of a high-density and high-calorific-value unconventional energy source. The natural gas hydrate (hereinafter referred to as "hydrate") has been attracting attention as a new type of clean energy. The global conservative estimate of marine hydrate reserves is $2.83\times10^{15}$ $m^3$, which is about 100 times of terrestrial resources. Therefore, the hydrate is considered to be the most promising alternative energy source in the 21st century. The Ministry of Land and Resources and other departments explored that the amount of China's prospective resources was about $680\times10^8$ t.

For the mining of marine hydrates, conventional methods use depressurization, heat injection, agent injection, displacement and other manners to cause the hydrates to release natural gas at the bottom of the well and mine the natural gas out. The basic principle of such methods is to decompose the hydrates into natural gas by means of depressurization, heat injection, agent injection, replacement and other technical means and then to mine the natural gas decomposed by the hydrates by conventional methods for mining natural gas. During the process of hydrate mining by depressurization, heat injection, agent injection, displacement, etc., sand particles generated by hydrate decomposition are carried into the shaft by natural gas, which causes the shaft safety problem during sand production at the bottom of the well. After the reservoir hydrate is decomposed, the original skeleton structure of the reservoir collapses and the formation stress field changes, resulting in production control risks such as collapse of the shaft and reservoir, as well as mining equipment being buried. The hydrate is decomposed into a large amount of natural gas, and the natural gas passes through the formation along pore channels of the formation and escapes from the sea surface into the atmosphere, resulting in various environmental risks. The problems of shaft safety, production control, and environmental risks faced by conventional hydrate mining methods are extremely serious. There is an urgent need for a mining method that can solve such problems faced by marine natural gas during the mining process.

SUMMARY

Technical Problem

An objective of the present invention is to overcome the defects of the prior art, and to provide an environment-friendly, high-efficient, safe and economic natural gas hydrate solid-state fluidization mining method and system under an underbalanced positive circulation condition.

Solution to the Problems

Technical Solution

To fulfill said objective, the present invention is implemented by the following technical solution:

a natural gas hydrate solid-state fluidization mining method under an underbalanced positive circulation condition mainly comprises the following steps:

S1, an earlier-stage construction process: performing first spudding on a well by a conventional drilling mode, forming a shaft subjected to first spudding, setting a guide pipe, injecting cement into an annulus between the shaft subjected to first spudding and the guide pipe to form a cement ring;

S2, an underbalanced hydrate solid-state fluidization mining construction process: setting a drill string and a drill bit into the guide pipe in S1 for drilling and mining operations; injecting seawater to the drill string during the drilling and mining operations, such that the seawater carries reservoir hydrate particles broken by the drill bit and silt out of the annulus formed by the drill string and a shaft; separating a mixed fluid of the carried hydrate particles and silt to obtain natural gas, seawater and silt, wherein a negative pressure is maintained at the bottom of the well during the entire process; keeping the drill string and the drill bit operating continuously till a designed well depth is reached; and S3, a silt backfilling process: injecting seawater and silt mined in S2 into a reservoir, forming a certain overpressure at the bottom of the well to achieve backfilling of the silt in the mined reservoir, and meanwhile, dragging an oil pipe upwards slowly to complete the backfilling of the entire shaft.

Preferably, in S2, natural gas is injected into an annulus formed by the drill string and the shaft, so that a liquid column pressure at the drill bit is lower than a reservoir pressure, and a negative pressure is formed at the bottom of the well.

Preferably, the seawater in S3 and silt mined and recovered in S2 enter the reservoir through the drill string and the drill bit, a hydraulic pressure at the drill bit is higher than the reservoir pressure, and therefore the silt backfilling is realized.

A mining system for the hydrate solid-state fluidization mining method under the underbalanced positive circulation condition according to claim 1 comprises a ground equipment system and an underwater system;

the ground equipment system comprises a drilling machine, a ground separation system, a liquefaction system, a liquefied natural gas tank, an offshore platform, a sand feeding tank, a natural gas pressure-stabilizing tank, a natural gas booster pump, a seawater suction pipeline, a seawater injection pipeline and a seawater injection pump;

the underwater equipment system comprises shafts, a drill bit, and a drill string, wherein the shafts include a shaft subjected to first spudding and an uncased shaft a guide pipe is arranged in the shaft subjected to first spudding; the uncased shaft is connected to the lower side of the shaft subjected to first spudding; the drill string passes through the guide pipe, the shaft subjected to first spudding and the uncased shaft in sequence;

the drilling machine is installed on the offshore platform; the liquefied natural gas tank, the liquefaction system and the ground separation system are connected in sequence; the ground separation system is connected to the guide pipe through a pipeline; the seawater suction pipeline is connected to the seawater injection pump; the seawater injection pump is connected to the seawater injection pipeline; the sand feeding tank is further disposed on the seawater injection pipeline; the seawater injection pipeline is connected to the drill string; the natural gas booster pump is connected to the natural gas pressure-stabilizing tank; the natural gas booster pump is connected to the guide pipe through a pipeline.

Preferably, the liquefied natural gas tank and the liquefaction system are connected through a liquefaction system and liquefied natural gas tank connecting pipe; a valve C is installed on the liquefaction system and liquefied natural gas tank connecting pipe; the liquefaction system and the ground separation system are connected through a separation system and liquefaction system connecting pipe; a valve B is installed on the separation system and liquefaction system connecting pipe.

Preferably, the ground separation system is connected to a seawater annulus outlet through the seawater recovery pipeline; the seawater annulus outlet is connected with the guide pipe; and a valve A is installed on the seawater recovery pipeline.

Preferably, an outlet of the seawater injection pump is connected with a seawater injection opening through a seawater injection pipeline; the seawater injection opening is connected with the drill string; and a valve E is installed on a seawater injection pipeline.

Preferably, the seawater injection pipeline is connected with the sand feeding tank through a silt injection pipeline, and a valve D is installed in the middle of the silt injection pipeline.

Preferably, the natural gas booster pump is connected with the natural gas pressure-stabilizing tank through a natural gas booster pump and natural gas pressure-stabilizing tank connecting pipeline; a valve F is installed on the natural gas booster pump and natural gas pressure-stabilizing tank connecting pipeline; the natural gas pressure-stabilizing tank is connected with a natural gas injection opening through a gas injection pipeline; the natural gas injection opening is connected with the guide pipe; and a valve G is installed on the gas injection pipeline.

Preferably, the guide pipe is fixedly connected with the shaft subjected to first spudding through a cement ring.

Preferably, the drill bit is a large-size drill bit.

Beneficial Effects of the Invention

Beneficial Effects

The present invention has the following advantages: according to the hydrate solid-state fluidization mining method under the underbalanced positive circulation condition, the production risks, such as collapse of the shaft and reservoir, and mining equipment being buried, faced by conventional natural gas hydrate mining methods such as depressurization, heat injection, agent injection and replacement are effectively solved. The problem of environment pollution caused by escape of natural gas decomposed from the hydrate is solved. By using this method, the weak-cementation non-rock-forming natural gas hydrates in the seafloor can be mined in environment-friendly, efficient, safe and economical modes.

BRIEF DESCRIPTION OF THE DRAWINGS

Description of the Drawings

The sole FIGURE is a schematic diagram of a natural gas hydrate solid-state fluidization mining method and system under an underbalanced positive circulation condition.

In drawings, reference symbols represent the following components: 1-drilling machine; 2-gas injection pipeline; 3-seawater injection opening; 4-seawater annulus outlet; 5-seawater recovery pipeline; 6-valve A; 7-ground separation system; 8-valve B; 9-ground separation system and liquefaction system connecting pipeline; 10-liquefaction system; 11-liquefaction system and liquefied natural gas tank connecting pipeline; 12-valve C; 13-liquefied natural gas tank; 14-sea surface; 15-offshore platform; 16-guide pipe; 17-cement ring; 18-shaft subjected to first spudding; 19-formation; 20-hydrate reservoir; 21-large-size drill bit; 22-encased shaft; 23-drill string; 24-seawater injection pipeline; 25-seawater injection pump; 26-seawater suction pipeline; 27-valve D; 28-sand injection pipeline; 29-sand feeding tank; 30-valve E; 31-natural gas booster pump; 32-valve F; 33-natural gas pressure-stabilizing tank; 34-valve G; 35-natural gas injection opening; 36-natural gas booster pump and natural gas pressure-stabilizing tank connecting pipeline.

EMBODIMENTS OF THE INVENTION

Detailed Description of the Embodiments

The present invention will be further described below with reference to the accompanying drawings, but the scope of the present invention is not limited to the followings.

As shown in the sole FIGURE, there is provided a mining system for a hydrate solid-state fluidization mining method under an underbalanced positive circulation condition. The mining system is mainly composed of a ground equipment system and an underwater system.

The ground equipment system comprises a drilling machine, a ground separation system, a liquefaction system, a liquefied natural gas tank, an offshore platform, a sand feeding tank, a natural gas pressure-stabilizing tank, a natural gas booster pump, a seawater suction pipeline, a seawater injection pipeline and a seawater injection pump.

The underwater equipment system comprises shafts, a drill bit, and a drill string, wherein the shafts include a shaft subjected to first spudding and an uncased shaft; a guide pipe is arranged in the shaft subjected to first spudding; the uncased shaft is connected to the lower side of the shaft subjected to first spudding; the drill string passes through the guide pipe, the shaft subjected to first spudding and the uncased shaft in sequence.

The drilling machine 1 is installed on the offshore platform 15. The offshore platform 15 floats on a sea surface 14. The liquefied natural gas tank 13 is connected with the liquefaction system 10 through a liquefaction system and liquefied natural gas tank connecting pipeline 11. A valve C12 is installed in the middle of the liquefaction system and liquefied natural gas tank connecting pipeline 11. The liquefaction system 10 is connected with the ground separation system 7 through a ground separation system and liquefaction system connecting pipeline 9. A valve B8 is installed in the middle of the ground separation system and liquefaction system connecting pipe 9. The ground separation system 7 is connected with the seawater annulus outlet 4 through a seawater recovery pipeline 5. A valve A6 is installed in the middle of the seawater recovery pipeline 5. One end of the seawater suction pipeline 26 is immersed into the sea surface 14 by a certain depth, and the other end of the seawater suction pipeline 26 is connected with the seawater injection pump 25. The middle of the seawater suction pipeline 26 is connected with the sand feeding tank 29 through a silt injection pipeline 28. A valve D27 is installed in the middle of the silt injection pipeline 28. An outlet of the seawater injection pump 25 is connected with a seawater injection opening 3 through the seawater injection pipeline 24. The seawater injection opening 3 is connected with the drill string 23. A valve E30 is installed in the middle of the seawater injection pipeline 24. The natural gas booster pump 31 is connected with the natural gas pressure-stabilizing tank 33 through a natural gas booster pump and natural gas pressure-stabilizing tank connecting pipeline 36. A valve F32 is installed in the middle of the natural gas booster pump and natural gas pressure-stabilizing tank connecting pipeline 36. The natural gas pressure-stabilizing tank 33 is connected with a natural gas injection opening 35 through a gas injection pipeline 2. The natural gas injection opening 35 is connected with the guide pipe 16, and the natural gas injection opening 35 is located below the sea surface 14 by a certain depth. A valve G34 is installed in the middle of the gas injection pipeline 2. A shaft 18 subjected to first spudding is located in a formation 19. The guide pipe 16 is located inside the shaft 18 subjected to first spudding, and the lower end of the guide pipe 16 is located at the bottom of the formation 19. The guide pipe 16 is fixedly connected with the shaft 18 subjected to first spudding through the cement ring 17. The hydrate reservoir 20 is located at the bottom of the formation 19. A large-size drill bit 21 is installed at the lower end of the drill string 23. In the hydrate reservoir 20, an encased shaft 22 is formed by breakage with the rotation of the large-size drill bit 21.

A natural gas hydrate solid-state fluidization mining method under an underbalanced positive circulation condition mainly comprises the following steps:

S1, an earlier-stage construction process: performing first spudding on a well by a conventional drilling mode, forming a shaft subjected to first spudding, sating a guide pipe, and injecting cement into an annulus between the shaft subjected to first spudding and the guide pipe to form a cement ring;

S2, an underbalanced hydrate solid-state fluidization mining construction process: setting a drill string and a drill bit into the guide pipe in S1 for drilling and mining operations; injecting seawater to the drill string during the drilling and mining operations, such that the seawater carries reservoir hydrate particles broken by the drill bit and silt out of the annulus formed by the drill string and the shaft; separating a mixed fluid of the carried hydrate particles and silt to obtain natural gas, seawater and silt, wherein a negative pressure is maintained at the bottom of the well during the entire process; keeping the drill string and the drill bit operating continuously till a designed well depth is reached; and S3, a silt backfilling process: injecting seawater and silt mined in S2 into a reservoir, forming a certain overpressure at the bottom of the well to achieve backfilling of the silt in the mined reservoir, and meanwhile, dragging an oil pipe upwards slowly to complete the backfilling of the entire shaft.

Preferably, in S2, natural gas is injected into the annulus formed by the drill string and the shaft, so that a liquid column pressure at the drill bit is lower than a reservoir pressure and a negative pressure is formed at the bottom of the well.

Preferably, the seawater in S3 and silt mined and recovered in S2 enter the reservoir through the drill string and the drill bit, a hydraulic pressure at the drill bit is higher than the reservoir pressure, and therefore the silt backfilling is realized.

The specific implementation process of the method is as follows.

In the earlier-stage construction process: a well is subjected to first spudding by a conventional drilling mode to form a shaft 18 subjected to first spudding, a guide pipe 16 is then set, and cement is injected to an annulus between the shaft 18 subjected to first spudding and the guide pipe 16 to form a cement ring 17.

In the underbalanced hydrate solid-state fluidization mining construction process: after the fixed connection of the guide pipe 16, the drill string 23 to which the large-size drill bit 21 is set. When the large-size drill bit 21 is located at the bottom of the guide pipe 16, drilling is stopped. The valve A6, the valve B8, the No. 3 valve C12, the valve E30, the valve F32 and the valve G34 are opened, respectively, and the ground separation system 7, the liquefaction system 10, the seawater injection pump 25, the natural gas booster pump 31 and the drilling machine 1 are started. While the drilling machine 1 drives the drill string 23 and the large-size drill bit 21 to rotate, seawater enters the seawater injection pump 25 along the seawater suction pipeline 26, then enters the seawater injection opening 3 along the sweater injection pipeline 24 after being pressurized by the seawater injection pump 25, and then passes through the large-size drill bit 21 along an inner hole of the drill string 23. In the meantime, natural gas which is pressurized by the natural gas booster pump 31 enters the natural gas pressure-stabilizing tank 33 through the natural gas booster pump and natural gas pressure-stabilizing tank connecting pipeline 36, and is then injected into the natural gas injection opening 35 through the gas injection pipeline 2, wherein the amount of gas injection is determined by the size of a value of the underpressure at the bottom of the well. As shown by a black arrow in the sole FIGURE, the hydrate particles fragmented by the large-size drill bit 21 and the silt are moved upward by seawater passing through the large-size drill bit along the annulus between the drill string 23 and the uncased shaft 22, pass through the annulus between the drill string 23 and the guide pipe 16, and are then converged with the injected natural gas at the natural gas injection opening 35. Since the natural gas enters until it is distributed throughout the annulus between the drill string 23 and the guide pipe 16, a liquid column pressure at the large-size drill bit 21 is lower than a reservoir pressure of the hydrate reservoir 20 at the large-size drill bit 21, no downhole leak will occur during the drilling process, and the mixed fluid can return out smoothly. During the upward movement of hydrate particles in the annulus, the hydrate particles will continue to be decomposed into natural gas due to the decrease in the annulus pressure and the increase in temperature. The mixed fluid formed after convergence at the natural gas injection opening 35 is transported to the seawater annulus outlet 4, and then enters the ground separation system 7 via a seawater recovery pipeline 5. The ground separation system 7 separates the natural gas and slit in the mixture out, wherein the natural gas enters the liquefaction system 10 along the ground separation system and liquefaction system connecting pipeline 9, and the liquefaction system 10 liquefies the natural gas and injects it into the liquefied natural gas tank 13 through the liquefaction system and liquefied natural gas tank connecting pipeline 11. The silt separated by the ground separation system 7 is loaded into the sand feeding tank 29. As the construction continues, the drill string 23 and the large-size drill bit 21 continue to move forward, and the depth of the encased shaft 22 continues to increase. The underbalanced hydrate solid-state fluidization mining construction process is repeated till a designed well depth is reached.

In a silt backfilling process: after the underbalanced hydrate solid-state fluidization mining construction process is completed, a large amount of silt separated by the ground separation system 7 is filled into the sand feeding tank 29. Then, the operation of the natural gas booster pump 31 is stopped after the valve G34 and the valve F23 are closed, and the valve D27 is opened. Under the action of siphon effect and gravity, the silt in the sand feeding tank 29 enters the seawater suction pipeline 26 through the sand injection pipeline 28. The silt entering the seawater suction pipeline 26 flows through the seawater injection pump 25, the seawater injection pipeline 24, the seawater injection opening 3, the inner hole of the drill bit 23 and the large-size drill bit 21 in sequence and then into the uncased shaft 22 along with the seawater. Since the injection of the natural gas is stopped, and a liquid column pressure at the large-size drill bit 21 is higher than a reservoir pressure of the hydrate reservoir 20 at the large-size drill bit 21, a downhole leak will occur. The fluid cannot return to the ground, thereby achieving successful backfilling of the silt in the uncased shaft 22. During the process of silt backfilling to the uncased shaft 22, the drill string 23 is slowly pulled upwards at the same time, thereby finally completing the backfilling of the entire uncased shaft 22.

According to the hydrate solid-state fluidization mining method under the underbalanced positive circulation condition, the production risks, such as collapse of the shaft and reservoir, and mining equipment being buried, faced by conventional natural gas hydrate mining methods such as depressurization, heat injection, agent injection and replacement are effectively solved. The problem of environment pollution caused by escape of natural gas decomposed from the hydrate is solved. By using this method, the weak-cementation non-rock-forming natural gas hydrates in the seafloor can be mined in environment-friendly, efficient, safe and economical modes.

The above contents are only preferred embodiments of the present invention. It should be noted that a number of variations and modifications may be made by those common skilled in the art without departing from the concept of the present invention. All the variations and modifications should all fall within the protection scope of the present invention.

The invention claimed is:

1. A natural gas hydrate solid-state fluidization mining method under an underbalanced condition, comprising the following steps:

S1, an earlier-stage construction process: performing first spudding on a well thereby forming a shaft subjected to first spudding, setting a guide pipe, injecting cement into an annulus between the shaft subjected to first spudding and the guide pipe to form a cement ring;

S2, an underbalanced hydrate solid-state fluidization mining construction process: setting a drill string and a drill bit into the guide pipe in S1 for drilling and mining operations in a reservoir; injecting seawater to the drill string during the drilling and mining operations, such that the seawater carries reservoir hydrate particles broken by the drill bit and silt out of an annulus formed by the drill string and the shalt; separating a mixed fluid of the carried hydrate particles and silt to obtain natural gas, seawater and silt, wherein a negative pressure is maintained at the bottom of the well during the entire process; keeping the drill string and the drill bit operating continuously until a designed well depth is reached; and S3, a silt backfilling process: injecting seawater and silt mined in S2 into the reservoir, forming a certain overpressure at the bottom of the well to achieve backfilling of the silt in the reservoir, and meanwhile, dragging the drill string upwards to complete backfilling of the entire shaft.

2. The natural gas hydrate solid-state fluidization mining method under an underbalanced positive circulation condition according to claim 1, wherein in S2, natural gas is injected into the annulus formed by the drill string and the shaft, so that a liquid column pressure at the drill bit is lower than a reservoir pressure, and a negative pressure is formed at the bottom of the well.

3. The natural gas hydrate solid-state fluidization mining method under an underbalanced positive circulation condition according to claim 1, wherein the seawater in S3 and silt mined and recovered in S2 enter the reservoir through the drill string and the drill bit, a hydraulic pressure at the drill bit is higher than the reservoir pressure.

4. A mining system for the natural gas hydrate solid-state fluidization mining method under the underbalanced condition according to claim 1, comprising a ground equipment system and an underwater system, wherein the ground equipment system comprises a drilling machine, a ground separation system, a liquefaction system, a liquefied natural gas tank, an offshore platform, a sand feeding tank, a natural gas pressure-stabilizing tank, a natural gas booster pump, a seawater suction pipeline, a seawater injection pipeline and a seawater injection pump;

the underwater equipment system comprises shafts, the drill bit, and the drill string, wherein the shafts include the shaft subjected to first spudding and an uncased shaft; the guide pipe is arranged in the shaft subjected to first spudding; the uncased shaft is connected to a lower side of the shaft subjected to first spudding; the drill string passes through the guide pipe, the shaft subjected to first spudding and the uncased shaft in sequence; the drill bit is connected to the bottom end of the drill string;

the drilling machine is installed on the offshore platform; the liquefied natural gas tank, the liquefaction system and the ground separation system are connected; the ground separation system is connected to the guide pipe through a pipeline; the seawater suction pipeline is connected to the seawater injection pump; the seawater injection pump is connected to the seawater injection pipeline; a sand feeding tank is further disposed on the seawater injection pipeline; the seawater injection pipeline is connected to the drill string; the natural gas booster pump is connected to the natural gas pressure-stabilizing tank; the natural gas booster pump is connected to the guide pipe through a pipeline.

5. The mining system according to claim 4, wherein the liquefied natural gas tank and the liquefaction system are connected through a liquefaction system and liquefied natural gas tank connecting pipe; a valve C is installed on the liquefaction system and liquefied natural gas tank connecting pipe; the liquefaction system and the ground separation system are connected through a separation system and liquefaction system connecting pipe; a valve B is installed on the separation system and liquefaction system connecting pipe.

6. The mining system according to claim 4, wherein the ground separation system is connected with the seawater annulus outlet through the seawater recovery pipeline; the seawater annulus outlet is connected with the guide pipe; and the valve A is installed on the seawater recovery pipeline.

7. The mining system according to claim 4, wherein an outlet of the seawater injection pump is connected with a seawater injection opening through a seawater injection pipeline; the seawater injection opening is connected with the drill string; and a valve E (30) is installed on a seawater injection pipeline.

8. The mining system according to claim 4, wherein the seawater suction pipeline is connected with the sand feeding tank through a silt injection pipeline, and a valve D is installed in the middle of the silt injection pipeline.

9. The mining system according to claim 4, wherein the natural gas booster pump is connected with the natural gas pressure-stabilizing tank through a natural gas booster pump and natural gas pressure-stabilizing tank connecting pipeline; a valve F is installed on the natural gas booster pump and natural gas pressure-stabilizing tank connecting pipeline; the natural gas pressure-stabilizing tank is connected with a natural gas injection opening through a gas injection pipeline; the natural gas injection opening is connected with the guide pipe; and a valve G is installed on the gas injection pipeline.

* * * * *